US005556258A

United States Patent [19]

Lange et al.

[11] Patent Number: 5,556,258

[45] Date of Patent: Sep. 17, 1996

[54] SQUEEZEBULB OPERATED SPORTS BALL PUMP

[76] Inventors: Robert F. Lange, 836 Balboa Ct.; Charles W. Davey, 838 Balboa Ct., both of San Diego, Calif. 92109

[21] Appl. No.: 489,898

[22] Filed: Jun. 12, 1995

[51] Int. Cl.[6] ..... F04B 43/00

[52] U.S. Cl. ..... 417/63; 417/440; 417/478; 417/480

[58] Field of Search ..... 417/63, 437, 440, 417/478, 479, 480; 92/92; 128/686; 273/61 D; 137/223

[56] References Cited

U.S. PATENT DOCUMENTS

| | | | |
|---|---|---|---|
| 282,090 | 7/1883 | Kennish | 92/92 |
| 342,131 | 5/1886 | Perkins et al. | 92/92 |
| 1,054,866 | 3/1913 | Pilling | 417/440 |
| 1,649,530 | 11/1925 | Holsinger | 417/63 |
| 3,906,939 | 9/1975 | Aronson | 128/2.05 G |
| 4,050,311 | 9/1977 | Leach | 128/2.05 G |
| 5,226,793 | 7/1993 | Stovall | 417/437 |

FOREIGN PATENT DOCUMENTS

| | | | |
|---|---|---|---|
| 50287 | 3/1985 | Japan | 417/478 |

*Primary Examiner*—Timothy S. Thorpe
*Assistant Examiner*—Roland G. McAndrews, Jr.

[57] ABSTRACT

A flexible, highly portable pump is designed for volleyball players but has wider applications. Motive force is delivered from a squeezebulb having a check valve at each end and communicating downstream to a fitting which will accept a ball inflation needle. A deflation valve is located in the air passageway downstream from the squeezebulb outlet check valve. The pump is designed so that it can be stuffed into a back pocket or thrown in a sports bag, and is flexible enough to be bent in two or wadded up and stuffed anywhere. The squeezebulb and relief valve are adapted for one-handed operation, and an optional one-piece solid state pressure gauge can be integrated into the body of the pump.

12 Claims, 1 Drawing Sheet

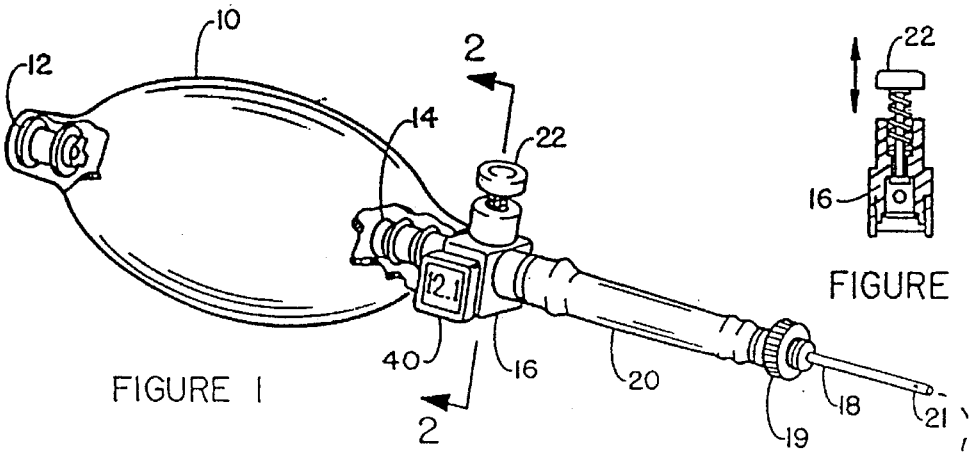
FIGURE 1
FIGURE 2
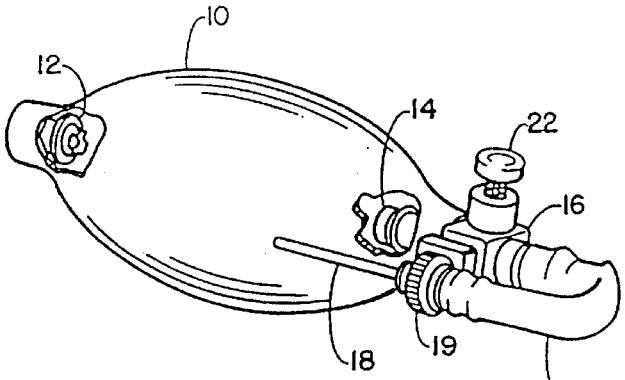
FIGURE 3
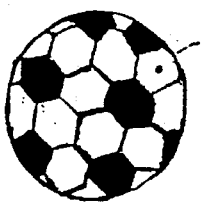
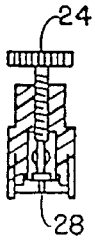
FIGURE 4
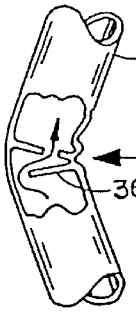
FIGURE 5
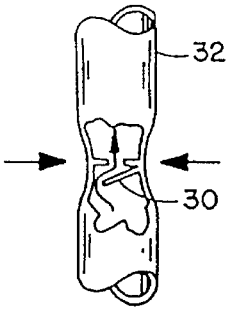
FIGURE 6
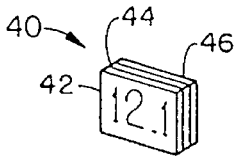
FIGURE 7
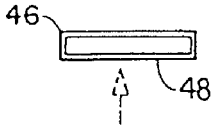
FIGURE 8a
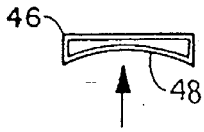
FIGURE 8b
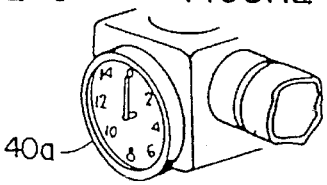
FIGURE 9

SQUEEZEBULB OPERATED SPORTS BALL PUMP

BACKGROUND OF THE INVENTION

The invention is in the field of inflation pumps and particularly relates to the inflation of low-pressure, low-volume inflatables such as volleyballs.

Commercially available manually operated pumps fall into two basic groups divided by by pressure rating. Low pressure pumps that are used for inflating air mattresses and inflatable boats, for example, are generally accordion- or bellows- like and operated with the foot like a treadle peddle. They are large and gangly because each gulp of air must be large enough that the air mattress inflation process lasts minutes rather than hours. These pumps may move a liter of air in each stroke, and though usually light enough in weight, between the wide connecting hoses and the sheer size and floppiness of the pumping chamber, they still rank relatively high in nuisance value.

At the high pressure end is the traditional bicycle pump and its progeny, used more for automobile tires than bicycles. Most of these pumps are capable of reaching the 90- to 120-pounds-per-square-inch of air pressure required by high performance racing bicycles. The pumps in this genus all operate on the same basic principle, having a piston and cylinder arrangement with a long piston shaft so that they are by their nature rigid.

Although it cannot be said that the well-designed, small cylindrical bicycle-mounted pumps are bulky, they are nonetheless bulky enough that they can not be conveniently stuffed into a pocket. Their rigidity and their axial size, even though they may be compact compared to ground-supported bicycle pumps, make them a nuisance to carry around to volleyball games. Like a hand axe, a folding stool or a belly board, the presence of the pump is just one more thing that must be lugged around and kept track of, one more piece of equipment in a gadget-weary world.

Almost all hand pumps divide along these lines, by pressure. There does not appear to be available a true hybrid pump, a bridge between two worlds and taking advantage of both. High pressure applications involve limited volumes of air, whereas pumps servicing the low pressure market are big on volume and weak in the pressure department, but how about applications which require neither high volume nor high pressure? A volleyball contains a six-inch cube of air at a pressure of 12 pounds per square inch. There is no available pump tailored specifically to applications in this range, servicing the crossover zone. And in particular, there is no pump that is designed specifically toward the unique needs of the volleyball player.

There are special considerations for volleyball that have to do with inflation. For example, in tournament play, both sides must agree on the pressure of the ball, with the pressure usually being checked by feel rather than numerically. If a bicycle pump is used, since it requires two-handed use, the player who is pumping the ball cannot feel the ball as it is being inflated so that he does not know when to stop. The other player may be feeling the ball, but the point at which he says "stop" may not satisfy the player doing the pumping. This can create a frustrating and antagonizing delay, if the ball is repeatedly over- or under-inflated before a mutually satisfactory pressure level is reached, since if the pressure does not satisfy both sides, the pumping has to start all over again. If the first player could at least feel the ball while pumping, he could discuss it with the other side, with both having a hand on the ball, and get it right the first time.

The ability to fine tune the pressure would be a great help. After over-inflating, incremental adjustments could be made, in small steps, until both sides agreed. But bicycle-style pumps are not subtle, they are either pumping, not pumping, or the needle adapter is unscrewed from the pump and the entire charge of air is gone in a "whoosh".

SUMMARY OF THE INVENTION

The invention fulfills the above-stated gap by providing a pump specifically for low volume, low pressure operation, and as such is small, light weight, flexible, and very highly portable, being foldable and having no rigid part longer than about two inches. Very significantly, it is also adapted to one-handed operation, a feature unheard of in high pressure pumps, or in a low pressure pump for that matter, unless the treadle pump, being "single footed", is counted.

The pump utilizes a simple squeezebulb for the motive force, the palm sized bulb being suited by it's nature to one-handed use. Check valves at either end of the bulb make it a pump, and a downstream relief or deflation valve permits the inflatable to be adjusted after inflation in the event of overfill. As an important option, a pressure gauge is built into the side of the pressure relief valve, operating on a solid state pressure transducer coupled to a LCD readout of the type popularized in the digital watch.

The squeezebulb has no inherent mechanical advantage and thus cannot generate high pressures without being specially adapted. The pressure of the hand on the bulb has to be equal to the pressure of the inflatable. Sports balls can be inflated with hand pressure, without mechanical amplification, but hand grip strength is inadequate for bicycle tire inflation. However, for sports balls and particularly for volleyballs, which operate at the lowest pressure of any commonly used sports ball, the squeezebulb is more than adequate. The approximately three square inches of palm surface multiplied by the 12 lbs/in$^2$ pressure in a volleyball permits the maximum pressure needed to be 36-pound squeeze.

The pump is designed particularly for volleyball, a sport whose popularity is on the upswing and which will no doubt continue to grow as baby boomers age, as volleyball is a sport that is truly enjoyable irrespective of one's skill or physical condition, within reasonable limits. Without taking away from the extreme skill, fitness and agility of top end players, it is a tribute to the sport that the threshold fitness level for enjoyment is low compared to skiing, tennis or basketball. Inasmuch as next year's (1996) olympics will for the first time include beach volleyball as a medal sport, it is fitting that the sport have it's own pump.

In the volleyball circuit, the pump design is such that it can be tossed from one player to another while plugged into the ball without risk of braking off the needle, a persistent problem in volleyball, and it fits easily into the pocket of beach shorts. Its single-handed use is particularly germane to volleyball as explained above. The ability to not only inflate the ball with one hand, but to actually fine tune the pressure with the same hand while squeezing the ball to check the pressure with the other hand, is a volleyball player's dreams come true.

The intuitive beliefs of the inventors that this small, flexible pump that can be stuffed inside a pocket would be popular among volleyball players, has been corroborated by volleyball professionals and public alike, who have reacted consistently enthusiastically to the pump.

BRIEF DESCRIPTION OF THE DRAWINGS

FIG. 1 is a perspective view of the invention;

FIG. 2 is a section taken along 2–2 of FIG. 1;

FIG. 3 illustrates the pump of the invention folded back in its doubled-over configuration;

FIG. 4 diagrammatically illustrates the rotary knob style relief valve;

FIG. 5 is a diagrammatic illustration of a bent tube relief valve illustrating the basic principal of its operation;

FIG. 6 illustrates a pinch-type relief valve;

FIG. 7 illustrates the solid state pressure gauge built into the side of the relief valve showing the liquid crystal read-out; and, FIGS. 8*a* and 8*b* are diagrammatic views of the transducer that forms the bottom of the three layers of the pressure gauge shown in FIG. 8 in different states of actuation;

FIG. 9 is a perspective view of a alternative pressure gauge with an analog readout.

DETAILED DESCRIPTION OF THE PREFERRED EMBODIMENTS

Referring to FIG. 1, the motive element of the pump is the squeezebulb 10, which is made of lightweight but tough rubber, and is similar to the squeezebulb of a sphygmomanometer. It has two check valves, check valve 12 being at the inlet of the squeezebulb, and check valve 14 being at the outlet. In the actual unit, check valve 12 is a ball check valve whereas 14 is a tulip-style flutter check valve and is actually mounted in the upstream end of the relief valve housing 16, but is nonetheless in the bulb outlet inasmuch as the upstream extension from the relief valve housing extends into the downstream end of the squeezebulb.

The minimum that is actually needed to make an operable pump is a single intake check valve, provided the pump is used with a needle adaptor such as that indicated at 18 which is engaged in a threaded socket 19 mounted in the end of the extension tube 20 which connects to the body of the relief valve 22. Operation requires the restriction of return air back to the squeezebulb and pump outlet, so that when the bulb is released, fresh air is sucked in through the check valve 12 rather than being pulled back in from the device being inflated. However, the pinhole airway 21 at the end of the needle adaptor through which the air must pass is so restrictive that it can substitute for the second check valve. Nonetheless, the pump works much better with two check valves as obviously the hole in the needle adaptor, while being restrictive, still admits considerable air while the bulb is expanding, which reduces pump efficiency and inflation speed. Therefore, practically speaking the second check valve is a virtual necessity inasmuch as the added cost is almost nothing and the added functionality is considerable.

One of the principle features of the pump is its small size and substantially complete flexibility. All of the structure is flexible except for a few effectively zero-dimensional valve parts and connections, small enough to be considerably less than the folded up, or wadded up, dimensions of pump in its entirety, so that their rigidity does not detract from foldability and flexibility. The longest unfoldable dimension is the length of the needle adaptor 18, sometimes referred to as the 'needle valve' or 'inflator needle'. The approximately two-inch length of the needle is the limiting overall dimension of the pump: it cannot be folded into a space which does not have at least one run greater than the length of the needle adaptor.

Substantially the same can be said for the pressure relief, or deflation, valve 22. This valve is not necessary for inflation. Its purpose is to release excess pressure from overinflating, and to deflate inflatables. It is recommended by the manufacturers that the ball be deflated between games. Also, in airline transport, balls should also be deflated, not only for compactness but also to protect the ball from possible inflation stress due to the low pressure at altitude.

The relief valve 22 in the preferred embodiment is shown in FIGS. 1–4, and is a simple push button valve in which the button shaft when depressed removes the valve head from its seat and air escapes from within the outlet passageway around the valve stem. This type of valve, positioned fight at the outlet of the squeezebulb, is virtually ideal because being thumb-operated it is tailored toward single-handed operation, which very much desired by volleyball players and other sportsman. This valve has a body 16 which mounts the valve itself and also defines a rigid corridor with connecting ends which are attach to the squeezebulb and the extension tube.

Other styles of valves could be used, and some are shown in FIGS. 4 through 6, including the rotary valve 24 of FIG. 4, which utilizes a cylinder or a sphere having a transverse port aligning with mating structure in the housing (not shown) and venting through orifice 28. A pinch valve is shown in FIG. 5 that is similar to the type used in some inflatable boats. The pinch valve is a check valve (although not used as one in this application) disposed in a flexible tube 32 that can be used to inflate the boat by mouth. By squeezing the sides of the tube the seating of the valve flap 30 is disrupted, permitting the escape of air. This type of valve could adapt easily to the instant invention, as it could be operated single-handedly by pressing it with the thumb against another pump part, or squeezing it between two fingers.

The bent tube relief valve of FIG. 5 is the type commonly found in helium dispensers used for mass balloon inflation. It has a flexible rubber spout 38 which when bent causes the flap 36 to unseat. This valve type is also adapted to one-handed operation.

A feature which adds considerably to the utility without adding as much to the cost as one would think, is the optional pressure gauge 40 shown in FIGS. 1, 8 and 9. The gauge has to be downstream of the second check valve to communicate with the inflatable. As shown in FIG. 8, the gauge can be conceptualized as a three-layer stack, the top layer 42 being the liquid crystal display module, with a second layer 44 being a combination pack containing the battery and the minimal circuit which includes the controller for the LCD readout and an analogue-to-digital converter, the LCD and ADC most likely being in separate off-the-shelf chips.

The lowest level 46 it is the pressure transducer itself, also shown in isolation in FIGS. 8*a* and 8*b*. The transducer is preferably solid state, comprising a panel 48 which when deflected by pressure is changed in its electrical properties, generally electrical resistance, or voltage in the case of the static charge of a piezoelectric crystal. Because of the tiny nature of state-of-the art designs for circuitry of this type, they are ideally suited for incorporation directly to a light-weight, state-of-the-art pump such as disclosed, with the transducer active element defining one wall of the pressurized air passageway. The benefit-to-cost ratio is again substantial, considering the gauge as a sales tool, in addition to achieving a reduction of ball wear in use.

An alternative analogue style pressure gauge is shown at 40*a* in FIG. 9.

The pump is shown with an extension hose 20 which makes the invention more appealing to purchasers, but in the most stripped-down embodiment the inflation needle will insert directly into the outlet of the relief valve. The extension tube actually expedites folding, as shown in FIG. 3, or wadding up, or rolling up the pump, so its addition helps compact the invention rather than making it bulkier, in practice. Its flexibility is a major prophylactic against needle breakage as well.

The invention fills a gap in the prior art that is also reflected as an apparent absence in the marketplace, and sales are expected to reflect that fact. If early acceptance is a meaningful indicator, such will become a reality in a relatively short time.

We claim:

1. A lightweight, flexible-bodied one-handed pump designed for optimum portability for use in low-pressure applications in which a mechanical advantage is not required for manual inflation, comprising:

(a) a flexible palm-sized squeezebulb defining an internal air chamber with an inlet and an outlet;

(b) an inlet check valve mounted in said inlet to admit ambient air into said squeezebulb;

(c) a needle adaptor having a pinhole outlet for use in inserting into a needle valve of a sports ball to deliver air thereto when said squeezebulb is squeezed;

(d) a flexible extension tube connecting and communicating between said outlet and said needle adaptor such that said outlet and said extension tube together define a passageway downstream of the air chamber of said squeezebulb and upstream of said needle adaptor;

(e) an outlet check valve defined in said passageway to obstruct backflow, whereby repeatedly squeezing and releasing said squeezebulb pumps consecutive bursts of air inhaled through said inlet to said needle adaptor; and (f) a relief valve the downstream of said outlet check valve operable to vent downstream pressure from a sports ball to the atmosphere for adjusting ball pressure after inflation, and for deflating same for storage between uses.

2. A pump according to claim 1 wherein said pump is substantially completely flexible and can be folded over on itself at least once.

3. A pump according to claim 1 wherein the longest rigid component of said pump is on the order of two inches long.

4. A pump according to claim 1 wherein said relief valve has a finger-operable actuator which is finger-operable with the fingers of a hand engaging said squeezebulb, such that said pump is single-handedly operable to both pump and vent.

5. A pump according to claim 4 wherein said relief valve is a thumb-operated push-button valve.

6. A pump according to claim 4 wherein said relief valve is a rotary knob valve.

7. A pump according to claim 4 wherein said relief valve is a pinch valve.

8. A pump according to claim 4 wherein said relief valve is a lateral deflection valve.

9. A pump according to claim 1 and including a pressure gauge mounted into said pump in communication with air downstream of said squeezebulb.

10. A pump according to claim 9 wherein said pressure gauge is integral with said pump and includes a liquid crystal readout on a side of said pump.

11. A pump according to claim 10 wherein said pressure gauge has a solid state pressure transducer and an integral control circuit interfacing same with said readout.

12. A pump according to claim 11 wherein said gauge is integral with said relief valve.

* * * * *